United States Patent [19]

Gravell

[11] 4,019,285

[45] Apr. 26, 1977

[54] DEVICES FOR MOUNTING LENSES FOR EDGE GRINDING

[75] Inventor: George William Gravell, London, England

[73] Assignee: Raphael's Limited, London, England

[22] Filed: Mar. 19, 1976

[21] Appl. No.: 668,729

Related U.S. Application Data

[63] Continuation of Ser. No. 523,853, Nov. 14, 1974, abandoned.

[30] Foreign Application Priority Data

Nov. 28, 1973 United Kingdom ..... 55189/73

[52] U.S. Cl. ..... 51/216 LP; 51/236

[51] Int. Cl.[2] ..... B24B 41/06

[58] Field of Search ..... 51/216 LP, 217 LK, 236

[56] References Cited

UNITED STATES PATENTS

| | | | |
|---|---|---|---|
| 2,166,037 | 7/1939 | Campos | 51/217 L |
| 2,441,472 | 5/1948 | D'Avaucourt | 51/216 LP |
| 2,597,543 | 5/1952 | Suben | 51/216 LP |
| 3,152,427 | 10/1964 | Prunier | 51/216 LP |
| 3,267,623 | 8/1966 | Block | 51/406 |
| 3,321,870 | 5/1967 | Bolden | 51/216 LP |

*Primary Examiner*—Harold D. Whitehead
*Attorney, Agent, or Firm*—Watson, Cole, Grindle & Watson

[57] ABSTRACT

This application discloses a device for mounting a lens between friction pads on the inner ends of coaxial rotatable shafts of a lens edge grinding machine. The device comprises a base which can be adhesively secured to one face of the lens, after removal of a protective peel-off strip which lightly adheres to a layer of adhesive on said base, and a key projecting from the back of said base. Said key is received in a keyway in one of said friction pads to locate the lens angularly in relation to said shafts. This friction pad engages the lens surface around said base so that the rotational drive is transmitted from the shaft to the lens direct from the friction pad surface and not through the key.

4 Claims, 9 Drawing Figures

DEVICES FOR MOUNTING LENSES FOR EDGE GRINDING

This is a continuation of application Ser. No. 523,853, filed Nov. 14, 1974 and now abandoned.

BACKGROUND OF THE INVENTION

This invention relates to devices for mounting lenses, particularly ophthalmic lenses, in edge grinding machines of the type in which the lens is gripped between a pair of pads at the ends of coaxial rotatable shafts in a movable head of the machine, so that the edge of the lens is presented to a grinding wheel. Fixed to one of the shafts so as to rotate with it is a template of the desired shape of the lens. By cooperating with a stationary stop or anvil, the template limits the extent to which the shaft axis can approach the grinding wheel. As the lens is slowly rotated against the surface of the rapidly rotating grinding wheel, the edge of the lens is progressively ground away until the lens has the same shape as the template.

It is necessary that the lens be accurately positioned in relation to the template so that it is optically correct when fitted into the spectacle frame. Not only must the optical centre of the lens be correctly located relative to the shaft axis (usually but not always, the centre will lie on this axis) but also, in the case of a lens having a cylindrical component of surface curvature, the cylinder axis must be orientated at the ophthalmically prescribed angle in relation to the horizontal.

A usual procedure is to place the already surface-ground and polished lens in an instrument which enables the power (magnification) of the lens to be checked, the lens centred, and cylindrical axis angularly oriented in relation to the horizontal as prescribed. The lens is then marked with removable marks to indicate its optical centre and its correct horizontal axis. These marks enable the lens to be mounted in the edge grinding machine in the correct position, both as regards optical centre and axis orientation, in relation to the template.

Various devices are used for mounting the lens in the machine in the correct position, but all have certain disadvantages which the present invention avoids.

SUMMARY OF THE INVENTION

According to the invention a device for mounting a lens in an edge grinding machine comprises a flexible base adapted to be adhesively secured to the lens surface, and a key projecting from the base.

The key is adapted to be received in a keyway in the friction pad of one of the lens-supporting shafts of the machine, which pad has a recess around the keyway to accommodate the base and which frictionally engages the said lens surface around the base.

Since the pad frictionally engages the lens surface directly, around the flexible base of the device, the force required to rotate the lens in the machine is transmitted to the lens directly via the friction pad, not via the keyway and key as is the case with certain prior locating devices which have an element adhesively affixed to the lens and through which the drive is transmitted to the lens.

Since the flexible element and the key do not have to transmit any rotational driving force but merely constitute a guide device for proper location of the lens blank, the device can be of very small size and simple construction, so that it is economically feasible to use it once and throw it away.

The device may comprise a base of elastomeric material such as rubber, synthetic rubber or flexible plastic, and the key extending from the base may be moulded in one piece with the base. To enhance the flexibility, the key may comprise two or more aligned projections with a gap or gaps between their adjacent edges.

The opposite face of the base may carry a layer of an adhesive. This layer may be protected by a peel-off strip, e.g. a strip of plastics film which adheres lightly to the adhesive layer. When the peel-off strip is removed, the exposed adhesive enables the device to be attached to the lens surface.

Owing to its flexibility the device can be applied to concave, plane or convex lens surfaces.

Because the device is surrounded by the pad during the edge grinding operation, the device is shielded from the cutting fluid used in the grinding.

DETAILED DESCRIPTION

The invention may be performed in various ways, and a specific embodiment will now be described by way of example with reference to the accompanying drawings, in which.

Figure 1:
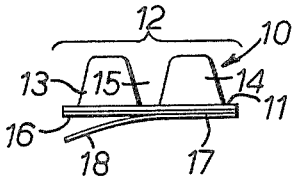
FIG. 1 is a side view of a device embodying the invention, showing a peel-off protective strip being peeled off to expose a layer of pressure-sensitive adhesive.
Figure 2:
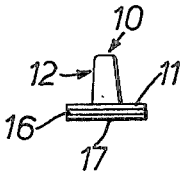
FIG. 2 is an end view of the device shown in FIG. 1.

Referring to the drawings, FIGS. 1 and 2 show a device 10 embodying the invention. The device comprises a thin flexible base 11 and, projecting from the base, a key 12. The key comprises two parts 13 and 14 disposed in line with a gap 15 between them. On the underside of the base 11 there is an adhesive layer 16. This is normally protected by a peel-off strip 17 of plastic film. In FIG. 1 the strip 17 is shown in the process of being peeled off, to expose the adhesive layer 16. It will be observed that the peel-off strip is somewhat longer than the base 11 so that its extremity 18 will project beyond the base, to facilitate removal of the strip. By way of example, the adhesive layer 16 may be a piece of pressure-sensitive adhesive tape with adhesive material on both faces, one face being stuck to the base 11 and the opposite face being protected by the peel-off strip 17.

The base 11 and the key parts 13 and 14 may be a one-piece moulding of a suitable plastics material.

FIGS. 1 to 4 are enlarged to show the details of the device more clearly. A convenient practical size for the device is: base length — 9 mm; base width — 4.5 mm;

base thickness — 0.4 mm; key height — 3 mm; key thickness — 1.6 mm.

Figure 3:
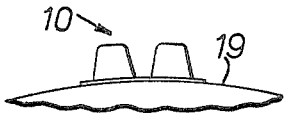
FIG. 3 shows the device mounted on the convex surface of a lens.
Figure 4:
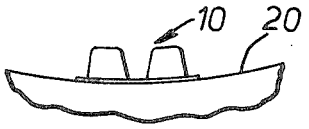
FIG. 4 shows the device mounted on the concave surface of a lens.

The base 11 is sufficiently flexible to enable the device 10 to be affixed to a convex lens surface 19 as shown in FIG. 3, or to a concave lens surface 20 as shown in FIG. 4, or of course to a flat surface. Making the key 12 in two parts 13 and 14 with a gap 15 between them enhances the flexibility of the base.

Figure 5:
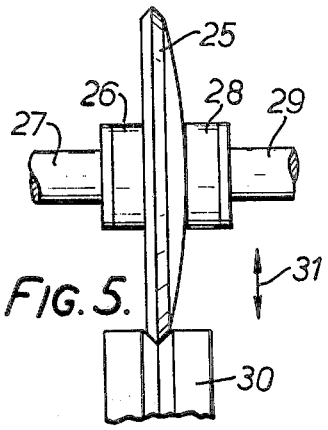
FIG. 5 is a view of part of an edge grinding machine showing a lens gripped between a pair of friction pads.

In use, the device is affixed to one surface of a lens blank in the correct position, as described below, and the lens blank with the device attached is mounted in an edge grinding machine for grinding the lens to the correct profile shape. As shown in FIG. 5, a lens 25 has had a device 10 (not visible in the drawing) fixed to its convex surface, i.e. the right-hand surface in the drawing, the lens is gripped between a left-hand friction pad 26 on the end of a rotatable shaft 27, and a right-hand friction pad 28 on the end of a rotatable shaft 29. The shafts 27 and 29 are coaxial and are rotatably mounted in a movable head of the machine (not shown) which can move towards and away from the edge of a grinding wheel 30 in the direction of the double arrow 31. The grinding wheel is rotated at high speed about a fixed axis. The extent to which the rotational axis of the shafts 27 and 29 can approach the grinding wheel 30 as the edge of the lens is ground away is limited by a template (not shown) fixed to the end of one of those shafts to rotate therewith, and which cooperates with a fixed anvil. Thus as the shafts 27 and 29, and the lens 25, are rotated, the grinding wheel 30 grinds away the edge of the lens until it has exactly the same profile shape as the template. During the grinding, the grinding region is liberally supplied with a suitable cutting fluid.

Figure 6:
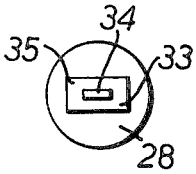
FIG. 6 is an end view of a friction pad, showing the recess and keyway to accommodate a device as shown in FIGS. 1 and 2.
Figure 7:
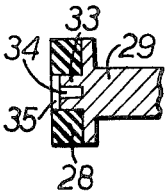
FIG. 7 is a sectional side view of the friction pad shown in FIG. 6.

The lens edge grinding operation and the machine in which the operation is performed, as so far described, are conventional and need not be described further. However, for use with a device according to the invention, e.g. the device 10 as illustrated, one of the friction pads is modified as shown in FIGS. 6 and 7. The end 33 of the shaft 29 is provided with a deep rectangular recess or keyway 34 which will accommodate the key 12. The friction pad 28 surrounds the shaft end 33 and projects beyond it, leaving a shallow rectangular recess 35 to accommodate the base 11 of the device. When the lens 25 is gripped between the pads 26 and 28, the key 12 enters the keyway 34 and the face of the pad 28 engages the lens surface around the base 11 of the device, which base occupies the shallow recess 35. The key 12 and the keyway 34 cooperate to locate the lens 25 with its optical axis coincident with the axis of the shafts 27, 29 and with the centre of the template, and also to locate the lens in the correct angular position relative to the template, provided of course that the device 10 has been affixed to the lens 25 in the correct position. The positioning and application of the device 10 will now be described with reference to FIGS. 8 and 9.

Figure 8:
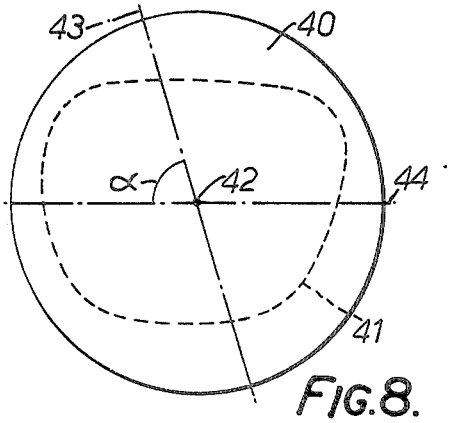
FIG. 8 shows a lens blank prior to application thereto of a device as shown in FIGS. 1 and 2.

FIG. 8 shows a circular lens blank 40 the optical surfaces of which have already been ground and finished. Shown in a broken line 41 is the desired outline of the finished lens, to fit the lens aperture of a spectacle frame. The optical centre 42 of the lens is required to be at a predetermined position in the frame, i.e. in line with the pupil of the wearer's eye. Also, in the case of an aspherical lens, e.g. a lens having a cylindrical component of surface curvature, the cylinder axis 43 must be oriented at the opthalmically prescribed angle a in relation to the horizontal 44. If the device 10 is affixed to the lens blank 40 with its centre coincident with the optical axis 42, and with its longitudinal axis correctly disposed at the angle a in relation to the cylinder axis 43, the lens blank will be correctly located relative to the axis of the shafts 27, 29 and of the template when the lens blank is fitted into the edge grinding machine. The template will have an outline shape corresponding to the desired outline 41 of the finished lens.

Figure 9:
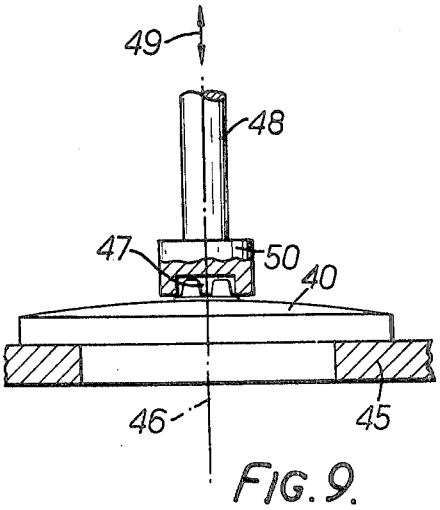
FIG. 9 is a side view, partly in section, of a lens blank having affixed thereto a device as shown in FIGS. 1 and 2.

The device 10 may be positioned and affixed to the lens blank 40 with the aid of a jig which is not a part of the present invention and portions of which are illustrated in FIG. 9.

The jig has a platform 45 on which the lens blank 40 is supported so as to be movable laterally in any direction, and angularly, in relation to an axis 46. The lens blank has previously been marked with removable marks to indicate its optical centre 42 (FIG. 8) and its correct horizontal axis 44, e.g. by three spaced spots aligned on the horizontal axis 44, the centre spot being the optical centre 42. These marks are applied in a known type of instrument which forms no part of this invention and need not be further described. The jig has a rod 48 which is movable towards and away from the platform 45. In at least the last portion of its movement towards the lens blank 40, the rod 48 is constrained to move along the axis 46, in the direction of the double arrow 49. The rod 48 has at its lower end a head 50 in which there is a keyway 47 corresponding to the keyway 34 shown in FIGS. 6 and 7. The jig has means for projecting a light beam along the axis 46, to project a shadow of a graticule and of the markings on the lens blank 40 onto a translucent screen. This screen is disposed above the lens 40, when the rod 48 has been moved out of the way. Thus it is possible to adjust both the translational and angular positions of the lens blank 40 in relation to the graticule. The screen is then removed and the rod 48 carrying the device 10 with the key 12 in the keyway 47 is moved downwards so that the device 10 is brought into the correct position on the lens blank 10. The adhesive layer on the base 11 of the device secures the device firmly to the lens.

What we claim as our invention and desire to secure by Letters Patent is:

1. A device for mounting a lens in an edge grinding machine, comprising: a key member adhesively secured to a surface of said lens in a centered and angularly oriented position, a pair of friction pad members adapted to engage said lens therebetween and to frictionally transmit rotational forces thereto; said key member comprising a lens surface conforming base and a key projecting from said base; and one of said pair of friction pad members having means defining a keyway which receives said key for aligning said one friction pad member in a centered and angularly oriented position relative to said lens, means defining a recess around said keyway which accommodates said base of said key member, and a surface surrounding said recess to engage said lens in frictional drive-transmitting relationship.

2. A device as in claim 1 in which said base and said key are molded in one piece from an elastomeric material.

3. A device as in claim 2 wherein said key is constituted by two aligned projections separated by a gap to enhance the lens surface conforming characteristics of said base.

4. A device as in claim 1 in which said key is constituted by two aligned projections separated by a gap to enhance the lens surface conforming characteristic of said base.

* * * * *